US005950648A

United States Patent [19]

Skrocki et al.

[11] Patent Number: 5,950,648

[45] Date of Patent: Sep. 14, 1999

[54] APPLICATION BRUSH CLEANING APPARATUS

[76] Inventors: Renee' M. Skrocki, 25198 Anna, Taylor, Mich. 48180; Rose M. Kerekes; Michael A. Kerekes, both of 4161 Westphal, Trenton, Mich. 48183

[21] Appl. No.: 09/156,350

[22] Filed: Sep. 18, 1998

[51] Int. Cl.[6] ..... B08B 3/00

[52] U.S. Cl. ..... 134/201; 206/209

[58] Field of Search ..... 15/189, 104.92, 15/423, 257.01, 257.05, 257.073, 257.07; 134/201; 206/209, 209.1; 211/65, 66; 401/127

[56] References Cited

U.S. PATENT DOCUMENTS

| | | | |
|---|---|---|---|
| 2,744,635 | 5/1956 | Hiss | 206/209 |
| 2,782,909 | 2/1957 | McNamara | 206/209 |
| 3,156,364 | 11/1964 | Wolcott | 206/209 |
| 3,465,872 | 2/1968 | Stapleton | 206/209 |
| 4,094,429 | 6/1978 | Urbin . | |
| 4,852,833 | 8/1989 | Lockwood | 248/110 |
| 5,269,809 | 12/1993 | Hayhurst et al. | 606/232 |
| 5,363,870 | 11/1994 | Doyon | 134/184 |

FOREIGN PATENT DOCUMENTS

| | | | |
|---|---|---|---|
| 1 603 367 | 11/1981 | United Kingdom | 211/66 |

OTHER PUBLICATIONS

Use and Care Guide of Brush Product of Creative Nail Design (Reg. TM); Dated Nov. 1996.

"Prevent Bad Hairdays" Article in *Nailpro*, Sep. 1998, pp. 32–36.

Brush Washer Product of Silver Lead Art Supply Catalog #056050600, 1997; p. 87.

Brush Cleaner Holders Products of the Supply Source, Advertised in Nails Magazine Oct. 1998; p. 147. Believed Advertised Before Sep. 18, 1997.

Silicoil Brush Cleaning Tank of the Lion Co., Inc., Louisville, KY. Dated 1954.

*Primary Examiner*—Frankie L. Stinson
*Assistant Examiner*—Paul J. Lee
*Attorney, Agent, or Firm*—Peter D. Keefe

[57] ABSTRACT

An application brush cleaning apparatus which prevents the handle of an application brush from contacting a bristle cleaning solution. Provided are an elongated container, a hollow pier situatable within the container and a resilient support washer having a brush seat characterized by a center hole and a plurality of radial slits communicating therewith. The container is preferably composed of clear glass. The pier is any structure which defines a rest and a central hollow, as for example a coil spring or an apertured pedestal. The pier is placed into the container and then the container is filled with a bristle cleaning solution to no more than the level of the rest of the pier. The handle is thrust into the brush seat of the support washer until the ferrule is frictionally held thereat. The washer and application brush combination is placed into the container, bristles first, wherein the bristles pass into the central hollow of the pier and into the bristle cleaning solution. When the support washer is supported by the rest of the pier, the bristles are substantially fully submerged and none of the handle is submerged. In the preferred embodiment of the present invention, a caddy is provided for holding, in a removable and stable manner, the container, a bottle of bristle cleaning solution, a combined support washer and application brush, and an eye dropper for transferring bristle cleaning solution from the bottle to the container.

11 Claims, 3 Drawing Sheets

APPLICATION BRUSH CLEANING APPARATUS

BACKGROUND OF THE INVENTION

1. Field of the Invention

The present invention relates to cleaning of application brushes used in the fingernail and art industries, and more particularly to a cleaning apparatus which provides suspension of the bristles of an application brush in a bristle cleaning solution.

2. Description of the Prior Art

Application brushes are generally composed of an elongated, cylindrical handle, a ferrule crimped on a near end of the handle, and a multiplicity of bristles held in a predetermined pattern by the ferrule. The bristles are held by the ferrule to provide an over-all predetermined shape and tip configuration, ranging, f or example, from a narrow arrangement having a very fine tip to a wide arrangement having a coarse or flattened tip. In either case, the bristles are of high quality, preferably from select animal fur. Accordingly, application brushes are regarded by fingernail technicians and art professionals as prized artistic tools.

Fingernail technicians and art professionals and their clientele depend upon the bristles of application brushes to precisely provide desired artistic renditions. However, no matter how high the quality of the application brush and no matter how high the expertise of the artist or fingernail technician, a client's finished product will look only as good as the present condition of the bristles will allow. This is because when an application brush is used, acrylic is acquired by the bristles, and unless this previously acquired acrylic is fully removed, the ability of the bristles to perform at their best during the next usage is compromised. Therefore, it has been a long standing concern of the fingernail and art industries to provide a reliable modality for cleaning acrylic or other debris from the bristles of application brushes.

A common conventional modality for performing periodic maintenance of the bristles is to gently wipe the bristles, with due care to preserve the bristle shape. For example, the bristles are placed into the fold of a paper towel and then the handle is used to roll the bristles to a point while pulling outwardly from the fold.

However, to thoroughly clean acrylic from the bristles so that a used application brush performs like a new one at its next use, the bristles must be placed for a considered length of time into a bristle cleaning solution. An application brush cleaner holder currently on the market consists of a cup for holding a bristle cleaning solution and at least one handle holder located at the upper rim of the cup. The handle holder has a snap fit receptacle for snappingly receiving the handle so as to suspend the bristles of the application brush into the bristle cleaning solution resident in the cup. This product, while operable, fails to prevent the handle of the application brush from coming into contact with the cleaning solution. This is a significant drawback because if the handle enters into the bristle cleaning solution, surf ace and/or structural deterioration of the handle will quickly set-in due to the chemical activity of the bristle cleaning solution. In this regard, it is absolutely vital that the handle be kept from contact with the bristle cleaning solution.

Accordingly, what is needed in the art is an application brush cleaning apparatus which prevents the handle of an application brush from contacting a bristle cleaning solution.

SUMMARY OF THE INVENTION

The present invention is an application brush cleaning apparatus which prevents the handle of an application brush from contacting a bristle cleaning solution.

The application brush cleaning apparatus according to the present invention is composed generally of an elongated container, a hollow pier situatable within the container and a resilient support washer having a brush seat characterized by a center hole and a plurality of radial slits communicating therewith. The container is preferably composed of clear glass. The pier is any structure which defines a rest and a central hollow, as for example a coil spring or an apertured pedestal.

In operation, a user places the pier into the container, then fills the container to no more than the rest of the pier. Next, the user takes in hand the support washer and an application brush and thrusts the distal end of the handle into the brush seat of the support washer, during which the handle enters the hole and the slits will resiliently yield to the varying diameter of the handle as it passes thereby. The user stops pushing the handle relative to the support washer when the ferrule is situated at, and held frictionally by, the brush seat. Now, the user grasps the handle and places the combined washer and application brush into the container, bristles first. In so doing, the bristles pass into the central hollow of the pier and into the bristle cleaning solution. When the support washer is supported by the rest of the pier, the bristles are substantially fully submerged and none of the handle is submerged.

In the preferred embodiment of the present invention, a caddy is provided for holding, in a removable and stable manner, the container, a bottle of bristle cleaning solution, a combined support washer and application brush, and an eye dropper for transferring bristle cleaning solution from the bottle to the container.

Accordingly, it is an object of the present invention to provide an application brush cleaning apparatus which provides f or immersing the bristles into the bristle cleaning solution without immersing the handle of the application brush thereinto.

It is an additional object of the present invention to provide an application brush cleaning apparatus which provides f or immersing the bristles into the bristle cleaning solution without immersing the handle of the application brush thereinto, wherein a caddy for stably holding articles associated therewith is provided.

These, and additional objects, advantages, features and benefits of the present invention will become apparent from the following specification.

DETAILED DESCRIPTION OF THE PREFERRED EMBODIMENT

Figure 1:
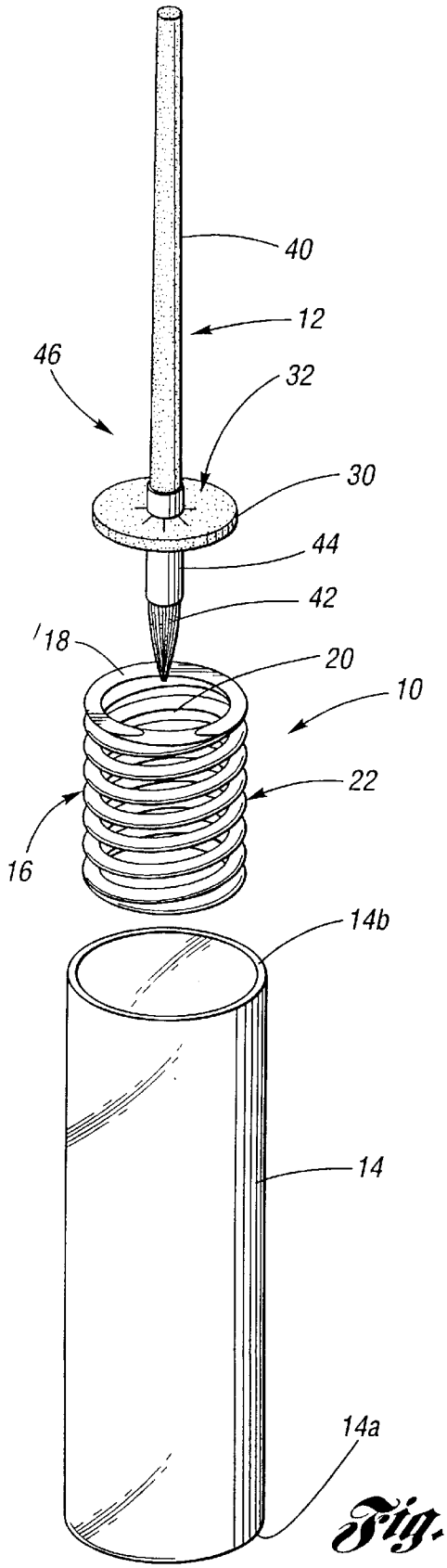
FIG. 1 is an exploded perspective view of a preferred application brush cleaning apparatus.
Figure 2:
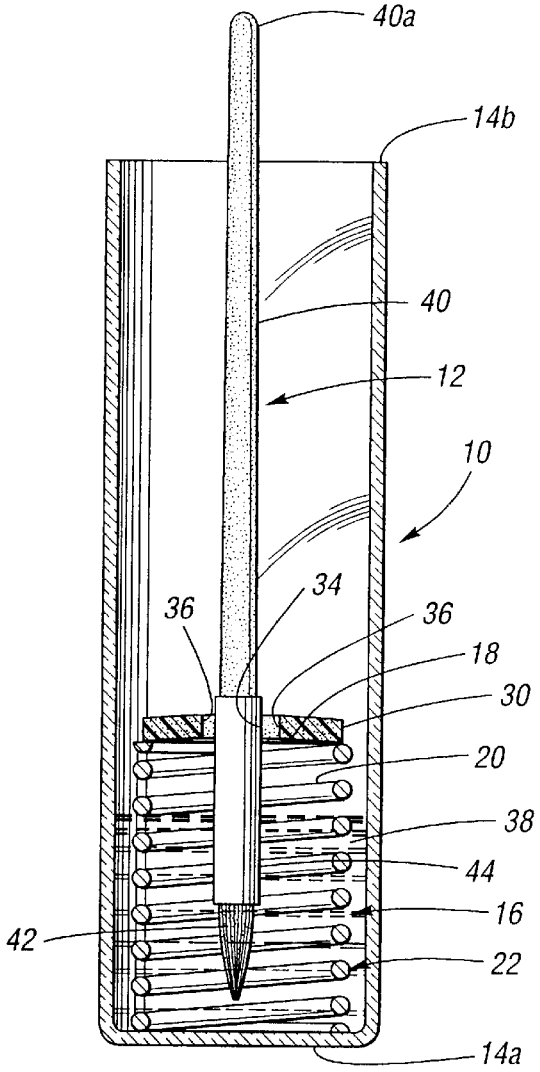
FIG. 2 is a partly sectional side view of the application brush cleaning apparatus of FIG. 1.
Figure 3:
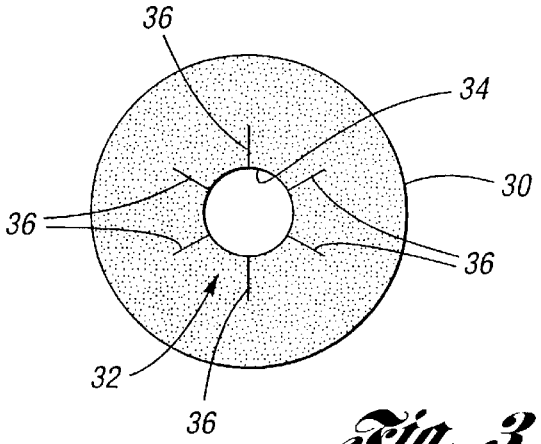
FIG. 3 is a top plan view of a support washer according to the present invention.

Referring now to the Drawing, FIGS. 1 through 4 depict an application brush cleaning apparatus 10, 10' shown in operation with respect to an application brush 12.

An elongated container 14 is preferably composed of clear glass, however, other materials which are acetone resistant may be utilized. The container 14 is closed at its bottom end 14*a* and is open at its top end 14*b*. It is preferred for the container to be of relatively small cross-sectional diameter as compared to its length, as for example about 1.5 inches in diameter and 5 inches in length.

Figure 4:
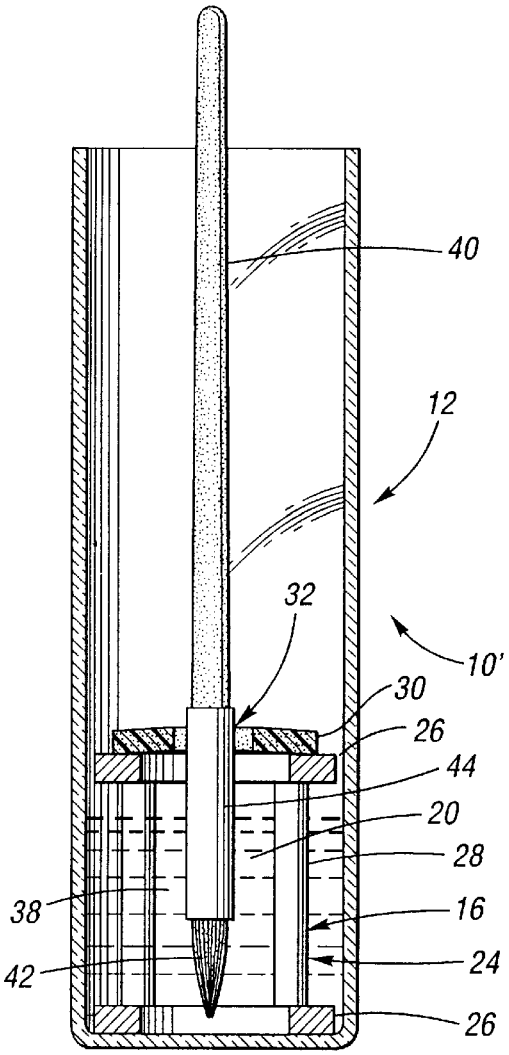
FIG. 4 is a partly sectional side view of a second preferred application brush cleaning apparatus according to the present invention.

Situated within the container 14 is a pier 16 which provides a rest 18. The pier 16 has a central hollow 20. FIG. 1 depicts a first preferred pier 16 in the form of a coil spring 22, preferably composed of stainless steel. FIG. 4 depicts a second preferred pier 16 in the form of a pedestal 24 in the form of upper and lower apertured disks 26 separated by a number of spaced legs 28 (as for example three legs). The diameter of the pier 16 is such that it is insertable into the container 14, and provides a generously proportioned central hollow 20 which easily allows the bristles 42 of an application brush 12 to be placed thereinto and admit of circulation of bristle cleaning solution 38 therearound (see FIGS. 2 and 4). Further, the height of the rest 18 is situated well inside the container 14, distantly separated from the upper end 14*b* and separated from the bottom end 14*a* a distance at least equal to the length of bristles of common application brushes. Using the above recounted container dimensions for example, a coil spring 22 type pier 16 may be about 1 inch in diameter and about 2 inches in length; and a pedestal 26 type pier has upper and lower apertured disks 26 having an aperture of about one-half inch in diameter.

A support washer 30 is dimensioned to fit within the container 14 and be stably restable upon the rest 18 of the pier 16. The support washer 30 is preferably composed of an acetone resistant, resiliently deformable material having a semi-rigid structure. A preferred material of construction of the support washer 30 is neoprene. The support washer 30 has a centrally disposed brush seat 32 composed of a hole 34 and a plurality of regularly spaced radial slits 36 communicating therewith. Preferably in this regard, there are six slits 36 which are each equally spaced at 60 degrees apart. The slits 36 allow for handle diameters oversized in relation to the hole 34 to be passed thereinto and be resiliently held thereat by friction therebetween. For example, the hole 34 may be from about 3 to about 6 millimeters in diameter; and in this regard, it is most preferred to provide two support washers, one having a 3 millimeter hole and the other having a 6 millimeter hole so as to accommodate a wide range of application brush sizes. Further for example, the slits 36 may be about 6 millimeters long, and the support washer 30 may be about 34 millimeters wide and about 5 millimeters thick.

In operation of the application brush cleaning apparatus 10, 10', a user places the pier 16 into the container 14 so that it rests upon the closed bottom end 14*a* thereof. The user then proceeds to fill the container with a bristle cleaning solution 38 to no more than the height of the rest 18 of the pier. An eye dropper may be used for this purpose (see hereinbelow). Examples of bristle cleaning solutions include acetone, monomer or a blend of chlorinated hydrocarbons. Next, the user grasps the support washer 30 and the application brush 12 and thrusts the distal end 14*a* of the handle 40 through the hole 34 in the support washer, during which the slits 36 will resiliently yield to the varying diameter of the handle as it passes thereby. The user stops pushing handle relative to the support washer when the ferrule 44 is situate in the brush seat 32. The brush seat 32 resiliently presses against the ferrule so that the ferrule is frictionally held thereat. Now, the user grasps the handle and places the support washer and application brush combination 46 into the container 14, bristles 42 first. In so doing, the bristles 42 pass into the central hollow 20 of the pier 16 and into the bristle cleaning solution 38. When the support washer 30 is supported by the rest 18 of the pier 16, the bristles 42 are substantially fully submerged in the bristle cleaning solution 38, and none of the handle is submerged thereinto. The rest 18 is situated such that the tip of the bristles 42 hangs free of the bottom end 14*a* of the container. Before again using the application brush, the support washer is slid thereoff.

Figure 5:
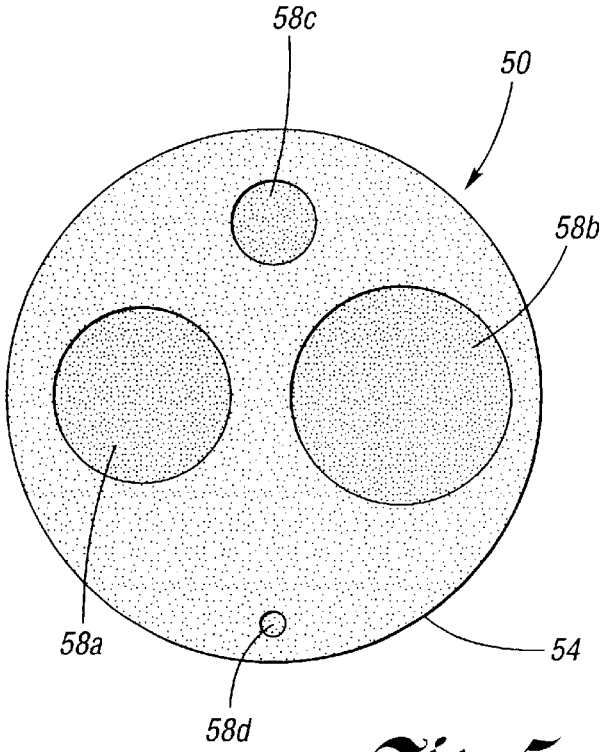
FIG. 5 is a top plan view of a caddy according to the present invention.
Figure 6:
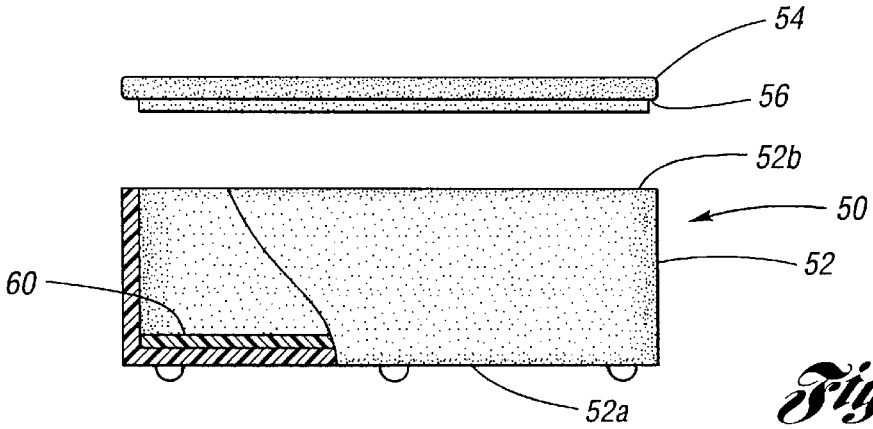
FIG. 6 is an exploded, partly cut-away side view of the caddy of FIG. 5.
Figure 7:
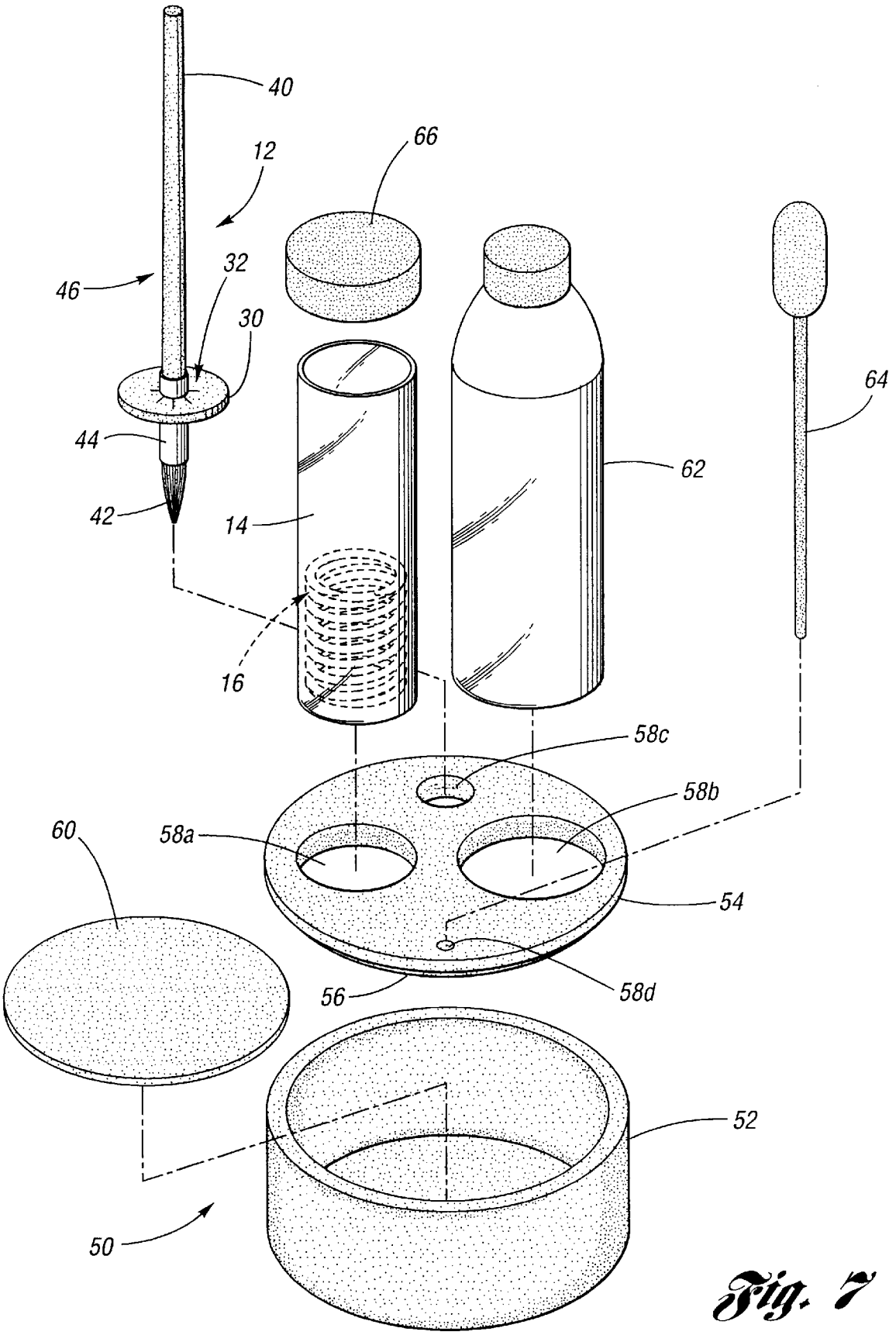
FIG. 7 is an exploded operational view of the application brush cleaning apparatus, caddy therefor and articles usable therewith.

As shown at FIGS. 5 through 7, it is preferred to include a caddy 50 with the application brush cleaning apparatus 10, 10'. The caddy 50 provides a convenient storage and usage facility, and importantly ensures a stable base so that the container 14 cannot be accidentally tipped over and the bristles 42 of the application brush 12 may be air dried after immersion in the bristle cleaning solution 38.

The caddy 50 includes a base 52 having a generally low-rise cup-shaped configuration, characterized by a closed bottom end 52*a* and open top end 52*b*. A lid 54 is placeable upon the top end 52*b* in a seated manner via an annular recess 56. The lid 54 includes a plurality of holes for receiving various components of, and articles associated with using, the application brush cleaning apparatus 10, 10', including a container hole 58*a*, a bottle hole 58*b*, a drying hole 58*c* and an eye dropper hole 58*d*. Each hole serves as a guide separated from the bottom end 52*a*, the respective combination forming receptacles that stably hold the indicated components and articles. By way of example in concert with the hereinabove dimensionals, the base 52 may be about 4.5 inches in diameter and about 1.5 inches in height. Preferably, pads are provided at the underside of the bottom end 52*a* of the base 52, such as for example composed of an anti-skid, resilient polymer.

Where the base is composed of an acetone damageable plastic, it is preferred for an acetone resistant protective disk 60, such as for example glass or an acetone resistant plastic, to be removably located at the closed bottom end 52*a* of the base 52. The protective disk 60 serves as a liner to protect the bottom end 52*a* of the base 52 from chemical damage which could otherwise occur if the bristle cleaning solution 38 contacted the base.

In operation of the caddy 50 as best shown at FIG. 7, a user places into the container hole 58*a* the container 14, places into the bottle hole 58*b* a bristle cleaning solution bottle 62, places into the drying hole 58*c* the support washer and application brush combination 46 (bristles 42 down), and places into the eye dropper hole 58*d* an eye dropper 64 for transferring bristle cleaning solution from the bottle 62 to the container 14.

The container 14 is situate in the container hole 58*a* prior to filling with bristle cleaning solution, and the support washer and application brush combination 46 is placed at the drying hole 58*c* for air drying of the bristles after cleaning of the bristles in the container, as recounted hereinabove, wherein the tip of the bristles hang free of the base and protective disk. Where bristle cleaning solution is to be left in the container 14, a cap 66 is placed over the open upper end 14*b* of the container to keep fumes contained in the container.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. An application brush cleaning apparatus for use with application brushes having a handle, a ferrule connected to the handle, and bristles connected to the ferrule, said apparatus comprising:

an elongated container having a closed bottom end and an open top end;

rest means located within said container;

washer means for resting upon said rest means, said washer means having a brush seat for frictionally engaging therein an application brush; and caddy means comprising:

a cup-shaped base having an open top and a closed bottom;

a lid placeable upon said open top, said lid having a plurality of apertures for receiving therethrough selected articles;

wherein when the ferrule of an application brush is held by said brush seat and said washer means rests on said rest means the bristles of the application brush are suspended in the container; and wherein said rest means comprises a pier restable upon said closed bottom, wherein said pier has a central hollow and a rest; wherein said washer means is restable upon said rest, and wherein when the ferrule of an application brush is held by said brush seat and said washer means rests upon said rest the bristles of the application brush are freely suspended in the container at said central hollow.

2. The apparatus of claim 1, wherein said pier comprises a coil spring.

3. The apparatus of claim 1, wherein said pier comprises a pedestal.

4. The apparatus of claim 1, wherein said washer means comprises a resilient washer having a center hole and a plurality of radially oriented slits communicating with said center hole.

5. The apparatus of claim 4, wherein said pier comprises a coil spring.

6. The apparatus of claim 4, wherein said pier comprises a pedestal.

7. The apparatus of claim 1, wherein said caddy further comprises:

a bottle of bristle cleaning solution; and an eye dropper;

wherein said plurality of apertures comprise a first aperture for receiving said container, a second aperture for receiving said bottle, a third aperture for receiving the application brush; and a fourth aperture for receiving the eye dropper.

8. The apparatus of claim 1, wherein said caddy further comprises a protective disk removably situated at said closed bottom.

9. An application brush cleaning apparatus for use with application brushes having a handle, a ferrule connected to the handle, and bristles connected to the ferrule, said apparatus comprising:

an elongated container having a closed bottom end and an open top end;

pier means restable upon said bottom end for providing a rest within said container, said pier means having a central hollow;

washer means having a brush seat for frictionally engaging therein an application brush and for resting upon said rest, wherein said washer means comprises a resilient washer having a center hole and a plurality of radially oriented slits communicating with said center hole; and caddy means for holding upright said container and for suspendably holding upright the application brush when held by said brush seat;

wherein when the ferrule of an application brush is held by said brush seat and said washer rests upon said rest the bristles of the application brush are freely suspended in the container at said central hollow.

10. The apparatus of claim 11, wherein said pier comprises a coil spring.

11. The apparatus of claim 11, wherein said pier comprises a pedestal.

* * * * *